US005441269A

United States Patent [19]

Henwood

[11] Patent Number: 5,441,269

[45] Date of Patent: Aug. 15, 1995

[54] PUTTING STROKE TRAINING DEVICE

[76] Inventor: Richard Henwood, 1496 Paloma Pl., Arroyo Grande, Calif. 93420

[21] Appl. No.: 294,118

[22] Filed: Aug. 22, 1994

[51] Int. Cl.[6] ..... A63B 69/36

[52] U.S. Cl. ..... 273/186.2; 273/184 R

[58] Field of Search ..... 273/186.2, 187.4, 183.1, 273/186.1, 434, 252

[56] References Cited

U.S. PATENT DOCUMENTS

| | | | |
|---|---|---|---|
| 3,788,647 | 1/1974 | Evens | 273/186.2 |
| 3,945,646 | 3/1976 | Hammond | 273/186.2 |
| 4,231,576 | 11/1980 | Perkins | 273/187.4 |
| 4,515,368 | 5/1985 | Petitjean | 273/186 A |
| 4,819,941 | 4/1989 | Tanaka | 273/186.2 |
| 5,080,362 | 1/1992 | Lillard | 273/184 R |

*Primary Examiner*—V. Millin

*Assistant Examiner*—Charles Anderson

*Attorney, Agent, or Firm*—Coudert Brothers

[57] ABSTRACT

The critical features of the putting stroke training device of the present invention includes Y-axis sensor means for detecting and signalling whether the face of a putter strikes a golf ball perpendicular to the path of the putter head and X-axis sensor means for detecting and signalling any abnormal acceleration or deceleration of the putter head. The Y-axis sensor means is disposed in a Y plane that is perpendicular to the golf ball striking face. The X-axis sensor means is disposed in an X plane that is perpendicular to the Y plane and is in the same plane as the shaft. This putting stroke trainer will assist the golfer in striking the ball with the club face perpendicular to the path of the putter head, and in developing a smooth pendulum swing and avoiding the "yips".

26 Claims, 6 Drawing Sheets

PT2 & PT3 = PHOTO-TRANSISTORS
LD6 = LD1
R30 = R4

PUTTING STROKE TRAINING DEVICE

FIELD OF THE INVENTION

This invention relates generally to the field of golf club training devices. More specifically, the invention is directed to an improved putting stroke training device to develop a smooth, consistent putting stroke by alerting the golfer when the putter head has accelerated or decelerated too rapidly or when the golfer opens or closes the club face when striking a golf ball.

BACKGROUND OF THE INVENTION

Many golf club training devices have been developed over the years; see U.S. Pat. Nos. 3,848,873; 4,148,096; 4,930,787; 5,131,660; 5,161,802; 5,169,151; and 5,184,826. Of these U.S. Pat. Nos. 4,930,787; 5,131,660; 5,161,802; and 5,169,151 are directed to putter training devices.

U.S. Pat. No. 4,930,787 teaches a device that produces a signal if the club head is rotated out of parallel with the horizon or the club head undergoes clockwise or counterclockwise rotation on the backstroke.

U.S. Pat. No. 5,131,660 discloses and claims a putter having an encoder wheel with a pendulum that rotates in response to the pendulum's rotation and a microprocessor/signal means for calculating the distance a golf ball travels when struck by a given backstroke.

U.S. Pat. No. 5,161,802 discloses and claims a golf club, including a putter, having means for generating a light beam parallel to the axis of the shaft in a direction away from the handle. The club produces a visual indication of the path of the ball in response to the manner in which the golfer makes a golf stroke. This enables the golfer to determine the accuracy of the stroke and the squareness of the club head to the target line.

U.S. Pat. No. 5,169,151 discloses and claims an electro-mechanical putting trainer in which an inertial sensor responds to the axial rotation during the backstroke of the putter. If the golfer allows the putter to rotate around the longitudinal axis of the putter's shaft, an alarm will sound.

A few of the putter training devices disclosed in the prior art are directed to correcting the problem of hitting the ball squarely, i.e. the ball must strike the face of the club perpendicular to the path of the club. However, none of the devices of the prior art attempt to correct the problem of "yips" which is common to high handicap, low handicap as well as professional golfers. "Yips" have been defined as:

(1) Accelerating too quickly on the backstroke, during the transition stroke between the backstroke and the forward stroke, or during the forward stroke; and (2) Decelerating during the transition stroke or during the forward stroke.

There is a need for a putting trainer device which will assist the golfer to strike the ball with the club face perpendicular to the club as well as to impart to the golfer a smooth pendulum swing with the proper tempo and thus avoiding the "yips".

SUMMARY OF THE INVENTION

The putting stroke training device of the present invention comprises a golf putter including an elongated shaft and a head having a sole plate, a top and a ball striking face substantially perpendicular to the sole plate, Y-axis sensor means for electronically detecting and signalling whether or not a user putts so that the head strikes a golf ball perpendicular to the path of the head, X-axis sensor means for electronically detecting and signalling any abnormal acceleration or deceleration of the putter head, and means for attaching each of the sensors to the putter. The latter means comprises a module for an electronic circuit that operates the sensor means and other electronic components of the device of this invention. The module can either be housed within the putter head itself or mounted on the top of the putter head. The Y-axis sensor means is disposed in a Y plane that is perpendicular to the golf ball striking face. The X-axis sensor means is disposed in an X plane that is perpendicular to the Y plane and is in the same plane as the shaft.

The putting stroke training device of this invention can also include Z-axis switch means within the module for activating the X-axis and Y-axis sensor means. The Z-axis means is an ON-OFF electrical switch that turns the sensor means on when the sole plate of the putter is raised and lowered against a hard surface. The Z-axis switch will turn off the sensor means the next time the putter is raised and lowered against the hard surface.

The putting stroke training device of this invention includes a signalling means. For example, the signalling means comprises light emitting diodes (LED's) as part of the sensor means to give visual signals to the user. Alternatively, a beeper or other audible alarm can either be combined with or substituted for the LED's to give an audible signal to the user. A first set of signals indicates to the user whether or not the ball striking face strikes the ball perpendicular to the path of the head. The second set of signals indicates to the user when the head is accelerating or decelerating abnormally.

More specifically, the Y-axis sensor means comprises first and second signalling means connected in the electronic circuit to give a visually and/or audibly distinguishing signal to the user whether or not the face of the club strikes a ball perpendicular to the path of the putter head, an electrical switch, e.g., a two pole switch with an intermediate terminal position, operably connected to the first and second light emitting diodes, an impact actuator mounted within the module and operably connected to a first terminal of the two pole electrical switch, a right electrical contact adjacent to the impact actuator and operably connected to a second terminal of the two pole electrical switch, and a left electrical contact adjacent to the impact actuator and operably connected to a third terminal of the two pole electrical switch. The impact actuator interprets whether the striking face of the putter is in an open position, a closed position, or the proper position. Upon such an interpretation, the impact actuator completes an internal circuit and closes the switch when the striking face is in an improper position, i.e., an open position or a closed position, and activates either the first or the second signalling means.

The X-axis sensor means comprises third and fourth signalling means connected in the electronic circuit to give a visually and/or audibly distinguishing signal to the user whether or not the club head is accelerating or decelerating abnormally, IR light pulse emitter, IR light pulse detector, a pendulum positioned within the path of light pulses between the emitter and the detector, and a fulcrum fixedly attached to the pendulum and rotatably mounted within the module. The third signalling means is activated when the Z-axis switch means turns on the sensor means and remains activated during a smooth pendulum-like stroke of the putter. The internal circuit of the X-axis means is completed when the pendulum moves out of the path of the pulses as a result of the user causing the putter head to move in other than a smooth pendulum-like stroke. This activates the fourth signalling means.

Each of the foregoing features of this invention will be more fully described below with reference to the following set of drawings.

DETAILED DESCRIPTION OF THE PREFERRED EMBODIMENT

Figure 1:
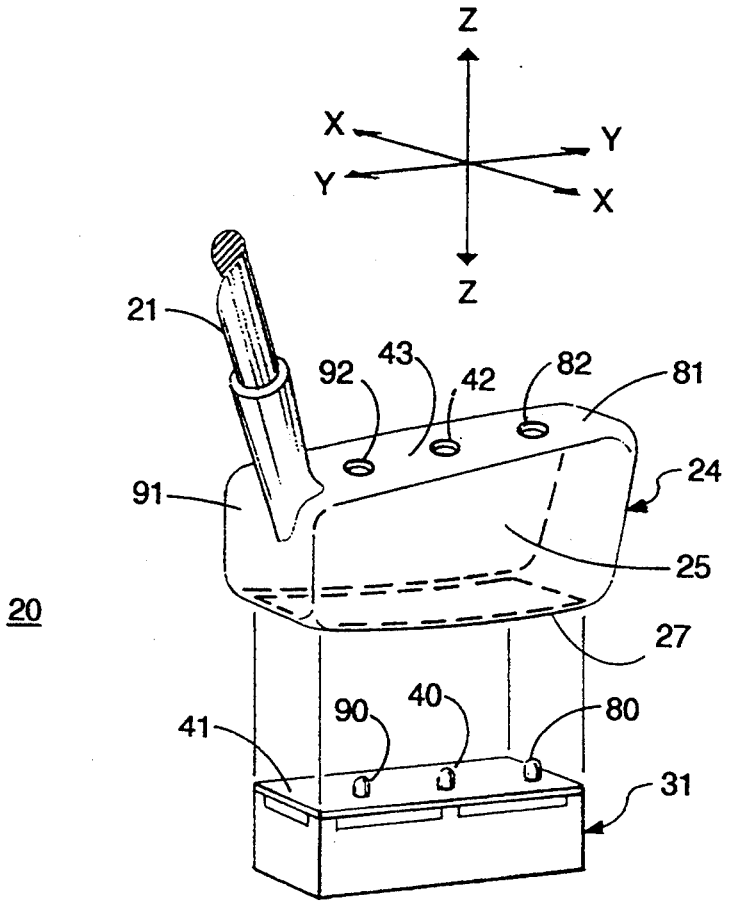
FIG. 1 is a top, front and left side perspective view of a preferred embodiment of the putting stoke training device of the present invention with reference the X-, Y- and Z- axes referred herein.
Figure 7:
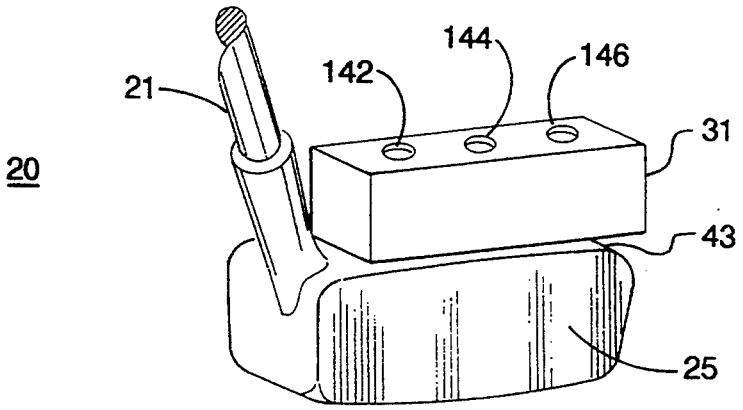
FIG. 7 is a top, front and left side perspective view of another embodiment of the device of the present invention.
Figure 2:
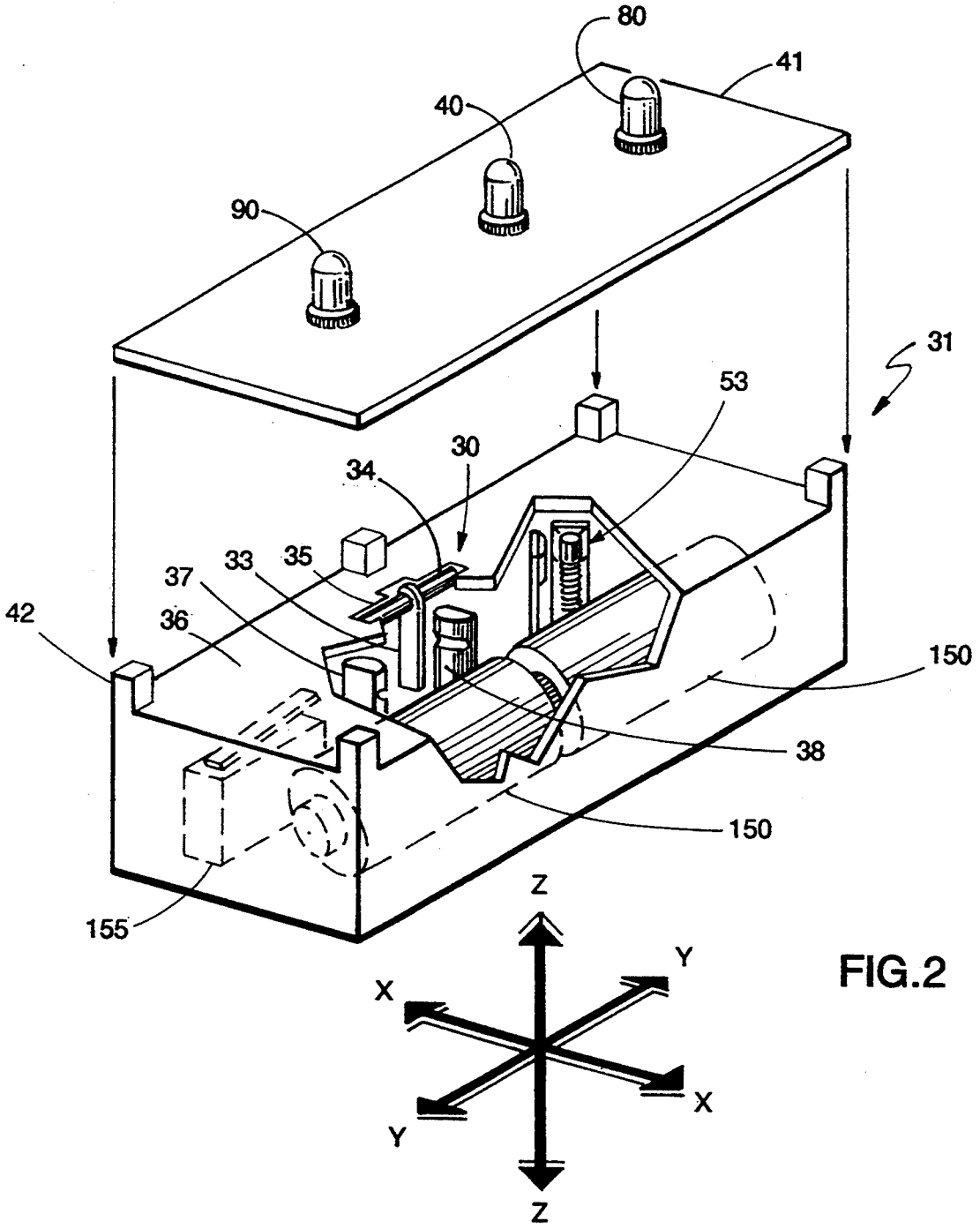
FIG. 2 is a top, rear and left side perspective, exploded view, partially broken away to show the X-axis sensor and the Y-axis sensor, of a preferred embodiment of the device of the present invention.

Turning now to FIGS. 1–2, the putting stroke training device is illustrated comprising putter 20 having elongated shaft 21 and a head 24 having ball striking face 25 and sole plate 27. Although putter 20 is for left handed golfers, it is apparent that the training device of this invention is equally adaptable for right handed golfers. X-axis sensor or pendulum sensor 30 is housed within module 31 which is either operably mounted within head 24 as shown in FIG. 1 or is fixedly attached on head 24 as shown in FIG. 7. X-axis sensor 30 comprises pendulum actuator 32 having pendulum 33 and fulcrum 34 rotatably mounted within module 31. Fulcrum 34 is positioned within grooves 35 in shelf 36 of module 31 so that it is along the Y-axis and parallel to striking face 25. Pendulum 33 is fixedly attached to fulcrum 34 and is along the Z-axis and perpendicular to sole plate 27. The remaining essential elements of X-axis sensor 30, shown in FIG. 3, include emitter 37 and detector 38 which are mounted within cavities (not shown) in floor 39 of module 31. Emitter 37 comprises a light emitting diode, LD1, and detector 38 comprises a photo-transistor, PT1, of the electronic circuit shown in the FIG. 8. Appropriate terminal designations 37A, 37B, 38A, and 38B operably connect emitter 37 and detector 38, respectively within the electronic circuit shown in the FIG. 8.

Sole plate 27 is normally positioned on the putting surface with shaft 21 substantially perpendicular to the surface of the putting green and with striking face 25 perpendicular to the path a golf ball will take to the hole, cup or other ball target. When putter 20 is in this position, pendulum 33 is in its "proper" or closed position. Pulses of light from emitter 37 to detector 38 form the optical-electrical function of the X-axis sensor means. Pendulum 33 hangs from grooves 35 in a manner to completely block the pulses of light between emitter 37 and detector 38, which are positioned along the Y-axis. When a golfer causes head 24 to move in other than a smooth pendulum-like swing, pendulum 33 swings along the X-axis. The position of pendulum 33 is interrogated by the IR pulses of light and an electric signal will be sent through the circuitry shown in FIG. 8 to cause red/green light emitting diode (LED) 40 to change from green to red. LED 40 comprises a red light emitting diode, LD3, and a green light emitting diode, LD4, shown in FIG. 8. The circuit is designed to cause the red light to remain on while pendulum 33 moves out of the path of the light pulsing between emitter 37 and detector 38. Printed circuit board (PCB) 41 is separated from the lower portion of module 31 by posts 42. The lower surface of PCB 41 contains the electronic circuit illustrated in FIG. 8.

A non-pendulum-like swing is the result of the golfer bringing head 24 back with a jerky motion or with too much acceleration or deceleration or suddenly stopping head 24 during the transition stroke or bringing head 24 forward with a jerky or decelerating motion. This type of improper swing will cause fulcrum 34 to rotate within grooves 35 of module 31 which in turn causes pendulum 33 to swing out of the path of light between emitter 37 and detector 38. On the other hand when the golfer uses a proper pendulum-like swing by moving head 24 with the combination of a smooth backstroke, a smooth transition stroke and a smooth forward, stroke pendulum 33 is designed to remain in the proper position, substantially parallel to shaft 21 and perpendicular to sole plate 27. By using a proper putting stroke, fulcrum 34 will not rotate within grooves 35 and pendulum 33 will remain to continuously block the path of light so that LED 40 stays green. Any interruption in the path of light causes LED 40 to change from green to red[as set forth above. The color of LED 40 is easily observed shinning from the opening 42 in top 43 of head 24 with peripheral vision as the golfer looks down at the ball.

Figure 4:
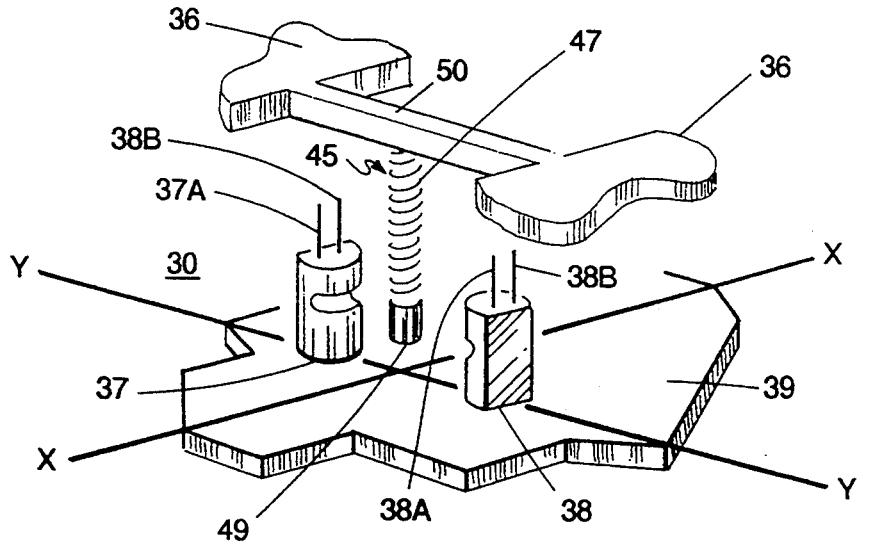
FIG. 4 is a top, front and right side perspective view of the X-axis sensor of another embodiment of the device of the present invention.

FIG. 4 illustrates another embodiment of X-axis sensor or switch 30 in which pendulum actuator 32 is replaced by spring actuator 45 which comprises spring 47 having weight 49 at one end and fixedly attached at the other end to stationary arm 50 in shelf 36 of module 31. Stationary arm 50 is fixedly attached to shelf 36 and is positioned along the Y-axis parallel to striking face 25. The combination of spring 47 and weight 49 serves exactly the same purpose as pendulum 33. A non-pendulum-like swing will cause spring 47 to move weight 49 out of interference with the light pulses between emitter 37 and detector 38 mounted within cavities in floor 39 of module 31.

Figure 5:
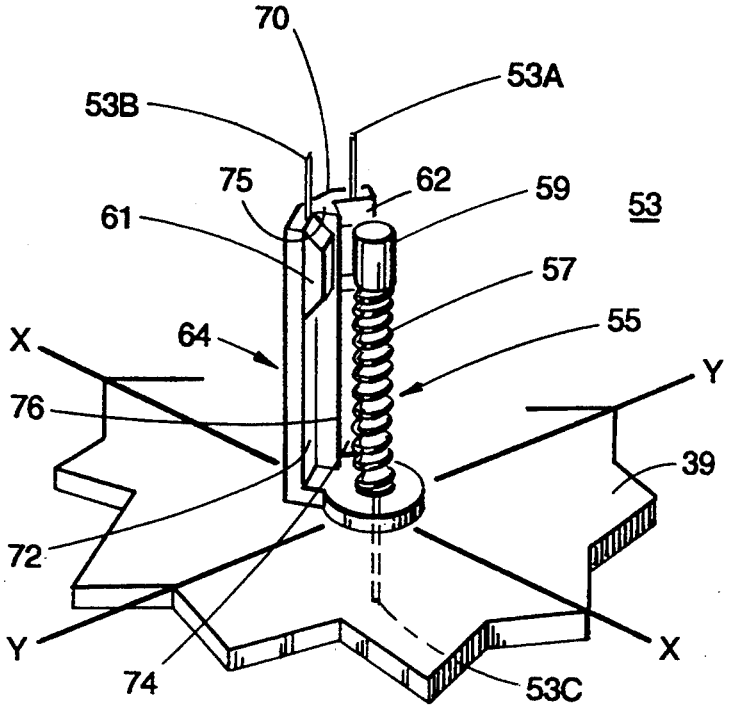
FIG. 5 is a top, rear and left side perspective view of the Y-axis sensor, of a preferred embodiment of the device of the present invention.
Figure 8:
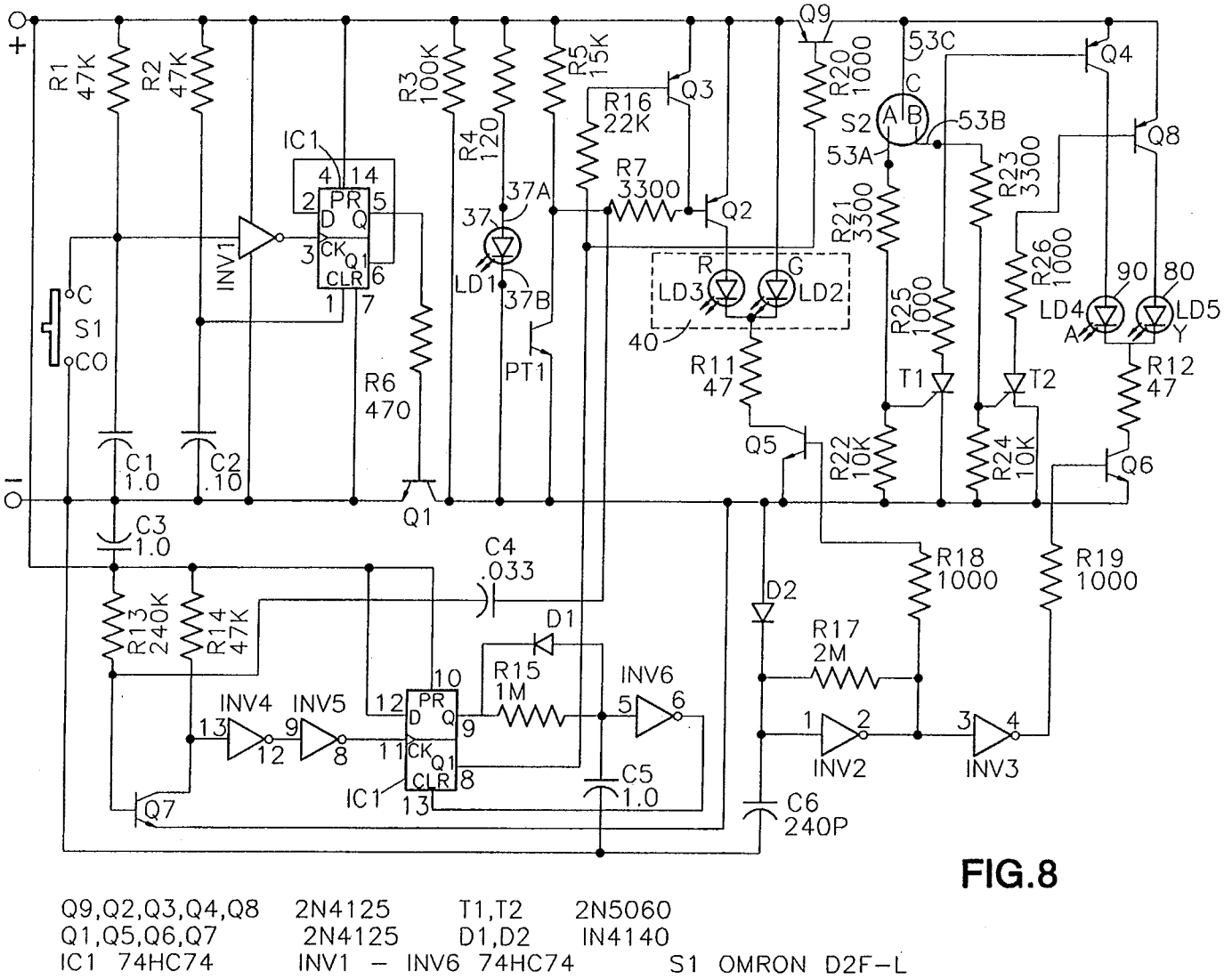
FIG. 8 is a block schematic diagram of an exemplary electronic circuit of the preferred embodiment of the present invention.

FIG. 5 illustrates Y-axis sensor or switch 53 with its terminals 53A, 53B and 53C operably connecting Y-axis sensor 53 within the electronic circuit shown in the FIG. 8. Y-axis sensor 53 comprises impact actuator 55 which includes spring 57 with its terminal 53C and weight 59, left electrical contact 61 with its terminal 53B, right electrical contact 62 with its terminal 53A, and support 64. Support 64 comprises upright leg 70 which is integrally molded with or mounted on floor 39 of module 31. Leg 70 has left inwardly directed inner side wall 72, right inwardly directed inner side wall 74, and stop 75. Y-axis sensor 53 has at least a portion of stop 75 directly between and in integral relationship with left and right side walls 72 and 74. In the embodiment shown in FIG. 5, stop 75 is in the form of a wedge having a triangular cross-section with edge 76 of the wedge diametrically opposite weight 59. It is critical to the operation of Y-axis sensor 53 to position actuator 55 within module 31 so that the edge 76 of stop 75 is along the X-axis and perpendicular to striking face 25. Weight 59 is in electrical communication with one end of spring 57 and electrical terminal 53C is connected to the other end of spring 57 so actuator 55 freely hangs within a cavity in module 31. Contact 61 is operably mounted to the left inwardly directed inner side wall 72 adjacent weight 59. Contact 62 is operably mounted to the right inwardly directed inner side wall 74 adjacent weight 59. By operably mounted, one skilled in the art recognizes that contacts 61 and 62 must be electrically insulated from contact with each other. This easily accomplished by using plastic or other non-conducting materials for module 31 and support 64.

Impact actuator 55 is the common conductor with the normally open electrical contacts 61 and 62. As club head 24 strikes the golf ball, the momentum of actuator 55 will follow the path of striking face 25 of head 24 along the X-axis. If face 25 is perpendicular to the X-axis path of head 24, weight 59 will strike edge 76 of stop 75 and actuator 55 will come to rest and will not come into contact with either left contact 61 or right contact 62. Since the circuit has not been completed, Y-axis switch 53 will remain off. On the other hand, if striking face 25 is open, i.e. if the point in floor 39 on the longitudinal axis of actuator 53 and parallel to the Z-axis, is greater than 1° to the right of the X-axis, weight 53 will touch left contact 61. In other words, when actuator 55 deviates from the X-axis, Y-axis sensor 53 interprets this out of proper position, referred to herein as a Y-axis vector. The moment left contact 61 completes the electronic circuit, yellow LED 80 adjacent to toe 81 of putter 20 is turned on for a period of time. LED 80 is also easily observed shining from the opening 82 in top 43 of head 24. Similarly, if striking face 25 is closed, i.e. if the point in floor 39 on the longitudinal axis of actuator 53 and parallel to the Z-axis is greater than 1° to the left of the X-axis, weight 53 will touch right contact 62. The moment right contact 62 completes the electronic circuit, amber LED 90 adjacent to heel 91 is turned on for about the same period of time. LED 90 is also easily observed shining from the opening 92 in top 43 of head 24.

Figure 6:
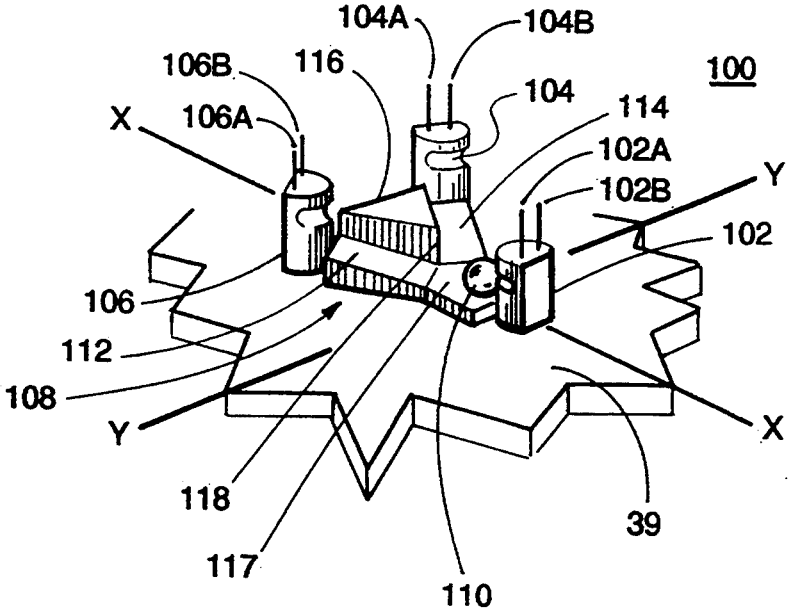
FIG. 6 is a top, rear and left side perspective view of another embodiment of the Y-axis sensor of the device of the present invention.
Figure 9:
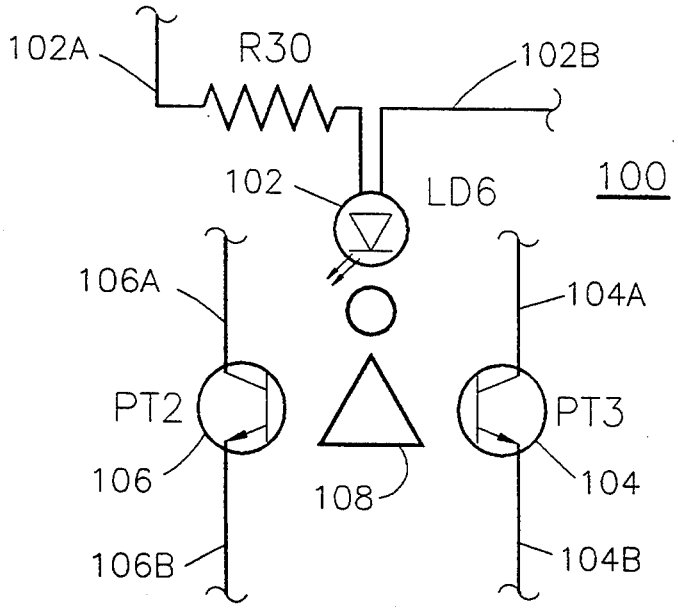
FIG. 9 is a block schematic diagram of another embodiment of the Y-axis sensor shown in FIG. 6.

FIG. 6 shows an alternative optical-mechanical Y-axis sensor 100 for use in place of electro-mechanical Y-axis sensor 53 described above in connection with FIG. 5. A block schematic diagram of the electronic circuit for Y-axis sensor 100 is shown in FIG. 9. Y-axis sensor 100 is disposed along the X-axis or perpendicular to striking face 25. Sensor 100 comprises emitter 102, terminals 102A and 102B, right detector 104, terminals 104A and 104B, left detector 106, terminals 106A and 106B, ball ramp 108 and ball 110. Ball ramp 108 comprises left inclined plane or ramp 112, right inclined plane or ramp 114, wedge 116 separating and in integral relationship with left and right ramps 112 and 114, and ball platform 117, positioned at the bottom edges of ramps 112 and 114 and adjacent to wedge 116. Wedge 116 has inner edge 118 diametrically opposite ball 110 that is on ball platform 117 when sole plate 27 of putter 20 is in its normal position on the putting surface. Sidewalls (not shown) are placed along left and right ramps 112 and 114 and a top (not shown) is used to cover sensor 100 to maintain ball 110 operably within sensor 100. The combination of emitter 102 and either detector 104 or detector 106 detects or interrogates the position of ball 110. If on impact with the golf ball, striking face 25 is perpendicular to the path of head 24, ball 110 will strike edge 118. In that case, ball 110 will not leave platform 117 and will continue to block the light pulses from emitter 102. Since Y-axis switch 100 in the circuit requires the light pulses to travel between emitter 102 and either left detector 106 or right detector 108, the yellow/amber LED's 80 and 90 will remain off.

The operation of Y-axis sensor 100 is very similar to that described above in connection with Y-axis sensor 53. Depending on whether face 25 is open or closed, ball 110 will travel up the left or right inclined planes, ramps 112 or 114 respectively towards left detector 106 or right detector 108 which act as a stop for ball 110. Therefore, Y-axis sensor 100 will interrogate that ball 110 is in the Y-axis, emitter 102 will be unblocked and the uninterrupted pulses of light will travel between to the unblocked detector. This will complete the necessary circuit to cause illumination of yellow LED 80 to indicate an open faced club or amber LED 90 to indicate a closed face club.

FIG. 7 shows an alternate embodiment of the putting stroke trainer of the present invention in which module 31 is mounted on top of any putter such as top 43 of putter 20 with shaft 21. Openings 142, 144 and 146 are located directly over amber LED, green/red LED, and yellow LED. Module 31 is removably mounted using any suitable type of fastener or clip so that putter 20 can be used without the use of the trainer of this invention.

FIG. 8 is a block schematic diagram of an exemplary electronic circuit according to the present invention. An exemplary embodiment of emitter 37 of X-axis switch comprises a light emitting diode LD 1 and an exemplary embodiment of detector 38 comprises a photo-transistor PT1. Examples of a suitable light emitting diode LD1 is BN505 and a suitable photo-transistor PT1 is PS505 sold by II Stanley Company. Appropriate terminal designations 30A, 30B, 31A, and 31B, are shown in the FIG. 3. Y-axis switch is shown in FIG. 5 with its terminals 53A–53C. An exemplary embodiment of the red/green light is shown at 40, and comprises a red light emitting diode LD3 and a green light emitting diode LD2. Exemplary embodiments of amber light 90 and yellow light 80 comprise light emitting diodes LD4 and LD5, respectively. Examples of the foregoing light emitting diodes are sold by Toshiba Corporation. They have the following part numbers: LD2/LD3 =TLRAG176, LD4=TLOA156P and LD5=TLYA156P.

A Z-axis switch S1, shown in phantom in FIG. 2 as switch 155, is used to switch the electronic circuit ON and OFF. An example of a switch S1 is OMRON D2F-L sold by Omron Corporation. Switch S1 along with resistors R1 and R2, capacitors C1 and C2, inverter INV1, D-type flip-flop IC1, and transistor Q1 operate to toggle power on and off to the remainder of the circuit each time switch S1 makes contact to its conduction terminals C and CO. An example of a suitable D-type flip-flop IC1 is Texas Instruments' 74HC74. S1 makes such contact, for example, when the putter is vertically tapped on the ground. When S1 is momentarily contacted, flip-flop IC1 is toggled between logic states (0 and 1) by switch S1 and inverter INV1. The Q output terminal of flip-flop IC1 is coupled to transistor Q1 via resistor R6, and renders Q1 conducting when the Q output is logic 1 and non-conducting when the Q output is logic 0. Capacitor C1 and resistor R1 provide de-bouncing of switch S1. Capacitor C2 and resistor R2 set flip-flop IC1 in a clear state upon initial application of power to the circuits, e.g., when battery cells 150, shown in phantom in FIG. 1, are first inserted into module 31.

The green diode LD2 is coupled between power and ground through resistor R11 and transistor Q5. Transistor Q5 alternates between a conducting and non-conducting state at a relatively high frequency (e.g., above 100 Hz), and therefore drives diode LD2 with pulsed power (so as to conserve energy). Transistor Q5 is operated by an oscillator circuit comprising a capacitor C6, a resistor R12, an inverter INV2, a diode D2, and a resistor R18. The configuration of this oscillator is well known in the digital electronics arts. The output of the oscillator appears at the output of the inverter INV2. It is also used to provide pulsed-power operation to the amber and yellow diodes LD4 and LD5 in a similar manner by way of another inverter INV3 and the components R19, R12, and Q6. The operation of the amber and yellow diode is described in further detail below.

The green diode LD2 is biased to normally emit light when the electronic circuit is ON. The exemplary embodiment shown in FIG. 8 is configured to switch the green diode LD2 off when sufficient current is coupled to red diode LD3. In the exemplary embodiment, the green diode LD2 has a light-emitting voltage threshold (e.g., 2.2 V) which is higher than emitting threshold of red diode LD3 (e.g., 1.8 V). Once current is passed through red diode LD3, it sets a voltage across resistor R11 which turns green diode LD2 off. Those skilled in the art will recognize that the turning-off of the green diode with the red diode is not a limitation on the scope of the present invention. For example, it is possible to allow the red light to turn on while the green light is still on so that the combination of green and red lights (e.g.,a brown colored light) provides the indication of an improper tempo in the golf swing.

Figure 3:
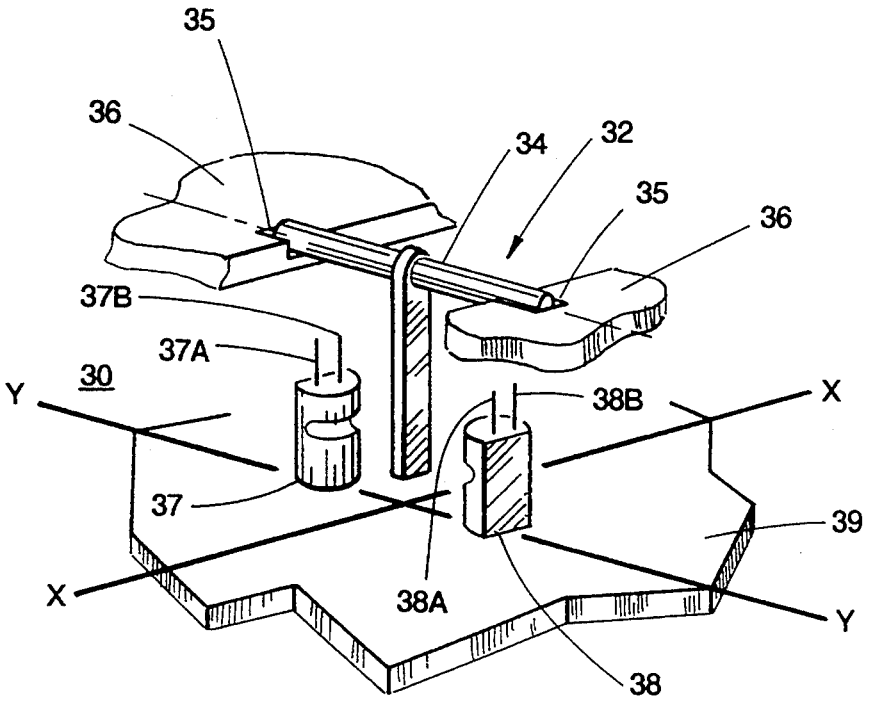
FIG. 3 is a top, front and right side perspective view of the X-axis sensor of a preferred embodiment of the device of the present invention.

The emitting state of the red diode is controlled, in part, by X-sensor 30 shown in FIG. 3, which is explained next. A resistor R4 provides power to LD 1 of the X-sensor to light it once the circuit is turned on by transistor Q1. A resistor R5 is coupled in series with photo-transistor PT1, with the combination coupled between power and ground. Transistor PT1 is normally non-conducting (open) when pendulum 33 of X-sensor 30 blocks light from emitter 37 (LD1). When the pendulum swings to one side and allows light from LD 1 to hit the base of transistor PT1, PT1 conducts current, with resistor R5 setting the maximum amount of current conducted, and the voltage at collector of PT1 decreases to near zero volts. This decrease causes current to be drawn from the base of transistor Q2. Transistor Q2 then turns on and lights red diode LED3 (and the green diode is off).

If the pendulum in X-sensor swings to one side for a prolonged period of time, as for example during an incorrect back-swing, detector PT1 remains conductive, thereby causing transistor Q2 and red diode LD3 to remain on. However, if the pendulum oscillates across the LD1's light beam at a relatively high frequency, a signal will be generated at the collector of PT1. This will trigger a blanking circuit that operates to disable the operation of the red diode LD3. Such a high-frequency occurs upon impact of the putter with the golf ball. If the putting swing has been correct up until impact with the ball, it is important that the red light is not lite, and that the green light remains on to indicate a proper swing. Upon detecting the impact with the golf ball under proper swing conditions, the blanking circuit will prevent the red diode from being lite for a predetermined amount of time (e.g., 3 seconds).

The blanking circuit comprises the following components: a D-type flip-flop IC2, three resistors R13–R15, two capacitors C4 and C5, a transistor Q7, a diode D1, and three inverters INV4–INV6. Examples of suitable inverters INV1–INV6 are National Semiconductor's 74HC14. Components D1, R15, C5, and inverter INV6 collectively comprise a delay circuit which sets the Q output of the flip-flop to a zero level at a predetermined time after the Q level has been set to a high level. Capacitor C4, resistors R13 and R14, transistor Q7, and inserters INV4 and INV5 detect the high frequency signal from PT1 and set the Q output of flip-flop IC2 to a high state whenever a high frequency oscillation is detected. The complementary output Q1 of flip-flop IC2 is sent to transistor Q3 via resistor R16. When a high frequency signal is encountered, the complementary Q1 output goes low, causing Q3 to be conductive. This in turn switches off the current to the red diode LED. As soon as the oscillations stop in pendulum 33 of the X-sensor, the Q1 output remains low for a predetermined amount of time (e.g. 3 seconds) and then goes high, which enables the red diode LD3 to be lite if the pendulum is tilted to allow light to hit the base of transistor PT1.

When the complementary output Q1 goes low, it also provides power to the circuitry associated with a Y-axis sensor switch 53, referred to in FIG. 8 as switch S-2, amber diode LD4 and yellow diode LD5. This power is provided through the activation of transistor Q9 through resistor R20. Once provided with power, switch S2 detects the appropriate Y-axis vector, if any, and activates the appropriate LED diodes LD4 and LD5. If no Y-axis vector is detected, neither diode LD4 nor diode LD5 is activated. If Y-axis sensor switch S2 contacts right contact 62, power is provided to fire a triac T1 through resistors R21 and R22. The firing of triac T1 draws current from the base of transistor Q4 which becomes conductive and activates amber diode LD4. If, instead, the pendulum in Y-axis sensor contacts left contact 61, power is provided to fire triac T2, which in turn draws current from base of transistor Q8. Transistor Q8 becomes conductive and activates yellow diode LD5. The power to both of light emitting diodes LD4 and LD5 is provided by pulse modulation via transistor Q6, as described above. After the blanking circuit times out, transistor Q9 is rendered non-conductive and power is disconnected from the Y-axis sensing circuit. In response thereto, triacs T1 and T2 become non-conductive if they were previously conductive. Thus, any of the diodes LD4 or LD5 that were on are turned off.

From the foregoing discussion of the electronic circuit diagram shown in FIG. 8, one skilled in the art recognizes that it is uniquely designed so that the circuitry can discriminate between the low frequency movement of pendulum actuator 32 during the backstroke, transition and forward stroke and the high frequency movement of pendulum actuator 32 during impact of striking face 25 with the golf ball. Therefore, irregular movement of actuator 32 at the instant of the ball strike is eliminated from electrical analysis made by the circuit. If the player has had a smooth backstroke, transition and forward stroke up until the time the ball is struck indicated by the low frequency of such movement, LED 40 remains green at the moment of ball strike during the high frequency movement of actuator 32. The IC circuit shown in FIG. 8 is powered by 2 N battery cells 150, shown in phantom in FIG. 1.

FIG. 9 is a block schematic diagram of the circuit for Y-axis sensor 100 shown in FIG. 6 which cart be substituted for switch 53 described above. A resistor R30 provides power to LD6 of Y-axis sensor 100 once the circuit is turned on by transistor Q9. Transistors PT2 and PT3 are normally non-conducting (open) when ball 110 of Y-axis sensor 100 blocks light from emitter 102 (LD6). When ball 110 travels up either ramp 112 or ramp 114 and allows light from LD6 to hit the base of either transistor PT2 or PT3, the switch is closed. Consequently, either triac T1 or triac T2 are fired as set forth above in connection with the discussion of Y-axis switch 53 to activate either the amber diode LD4 or yellow diode LD5.

Without departing from the spirit and scope of this invention, one of ordinary skill in the art can make many other changes and modifications to the putting stroke training device of the present invention to adapt it to specific usages and conditions. A beeper such as those found in a smoke alarm system to give an audible signal to the user could be combined with the LED's or could replace the LED's of the preferred embodiment of this invention. As such, these changes and modifications are properly, equitably, and intended to be, within the full range of equivalents of the following claims.

What is claimed is:

1. A putting stroke training device comprising a golf putter including an elongated shaft and a head having a sole plate, a top and a golf ball striking face substantially perpendicular to said sole plate;

Y-axis sensor means for detecting and signalling whether said face strikes a golf ball in a proper position with said face perpendicular to the path of said head, said Y-axis sensor means being disposed in a Y plane that is perpendicular to said golf ball striking face;

X-axis sensor means for detecting and signalling any abnormal acceleration or deceleration of said putter head, said X-axis sensor means being disposed in an X plane that is perpendicular to the Y plane and is in the same plane as said shaft; and means for attaching each of said sensors to said putter.

2. The putting stroke training device of claim 1 wherein a Z-axis switch means for activating said X-axis and Y-axis sensor means when said sole plate of the putter is raised and lowered against a hard surface is operably connected to said X-axis and Y-axis sensor means.

3. The putting stroke training device of claim 2 wherein said means for attaching each of said sensors to said putter comprises a module and said module contains a printed circuit board for an electronic circuit for operating said Y-axis sensor means, said X-axis sensor means and said Z-axis sensor means.

4. The putting stroke training device of claim 1 wherein said X-axis means and said Y-axis means include signalling means to indicate to the user whether said ball striking face strikes the golf ball perpendicular to the path of the head and whether said head is accelerating or decelerating abnormally.

5. The putting stroke training device of claim 1 wherein said signaling means comprises a plurality of light emitting diodes.

6. The putting stroke training device of claim 5 wherein said signalling means also includes at least one audible alarm.

7. The putting stroke training device of claim 1 wherein said signalling means comprises at least one audible alarm.

8. The putting stroke training device of claim 1 wherein said means for attaching each of said sensors to said putter comprises a module.

9. The putting stroke training device of claim 8 wherein said module is mounted within said putter.

10. The putting stroke training device of claim 8 wherein said module is mounted on said top of said putter.

11. The putting stroke training device of claim 8 wherein said module contains a printed circuit board for an electronic circuit for operating said Y-axis sensor means and said X-axis sensor means.

12. The putting stroke training device of claim 11 wherein said X-axis means and said Y-axis means include first and second set of light emitting diodes connected in said electronic circuit to respectively give visual signals to the user whether said face strikes the golf ball perpendicular to the path of said head and whether said head is accelerating or decelerating abnormally.

13. The putting stroke training device of claim 12 wherein said light emitting diodes are mounted on the top of said printed circuit board and are readily visible to the user during a putting stroke.

14. The putting stroke training device of claim 12 wherein said Y-axis sensor means comprises a Y-axis sensor electrical switch operably connected to first set of said light emitting diode, an impact actuator for interpreting whether said striking face of said putter is in an open position, a closed position, or the proper position, said impact actuator mounted within said module and operably connected to a first terminal of said Y-axis sensor electrical switch, a right electrical contact adjacent to said impact actuator and operably connected to a second terminal of said Y-axis sensor electrical switch, and a left electrical contract adjacent to said impact actuator and operably connected to a third terminal of said Y-axis sensor electrical switch, whereby said impact actuator completes an internal circuit and closes said switch when said striking face is in an open or a closed position and activates the first set of said light emitting diodes.

15. The putting stroke training device of claim 12 wherein said Y-axis sensor means for determining whether said striking face of said putter is in an open position, a closed position, or the proper position is mounted within said module and comprises a ball platform having right and left edges, a right inclined plane integrally attached to the right edge of said platform, a left inclined plane integrally attached to the left edge of said platform, a free standing ball on said ball platform and capable of traveling up said right and left inclined planes, a ball stop, a Y-axis sensor electrical switch operably connected to the first set of said light emitting diodes of said electronic circuit, IR light pulse emitter adjacent said ball platform, positioned diametrically across from said ball stop and operably connected to said Y-axis sensor electrical switch, right IR light pulse detector for receiving pulses of light from said emitter when said emitter becomes unblocked by said ball traveling up said left inclined plane and operably connected to said electric switch, left IR light pulse detector operably connected to said Y-axis sensor electrical switch for receiving pulses of light from said emitter when said emitter becomes unblocked by said ball traveling up said right inclined plane, whereby the position of said ball is detected by said left or right detectors when said striking face is in an open or a closed position and the first set of said light emitting diodes is activated.

16. The putting stroke training device of claim 12 wherein said X-axis sensor means operably connected to a second set of said light emitting diodes, which comprises IR light pulse emitter, IR light pulse detector, a pendulum positioned within the path of light pulses between said emitter and said detector, and a fulcrum fixedly attached to said pendulum and rotatably mounted within said module, whereby an internal circuit of said electrical switch is completed said pendulum moves out of the path of said pulses as a result of the user causing said putter head to move in other than a smooth pendulum-like stroke and activates the second set of said light emitting diodes.

17. A putting stroke training device comprising a golf putter including an elongated shaft and a head having a sole plate, a top and a ball striking face substantially perpendicular to said sole plate;

a module operably attached to said putter;

Y-axis sensor means disposed in a Y plane that is perpendicular to said ball striking face and comprises first and second light emitting diodes connected in an electronic circuit to give a visual signal to the user whether said face strikes a golf ball perpendicular to the path of said head, a Y-axis sensor electrical switch operably connected to said first and second light emitting diodes, an impact actuator for interpreting whether said striking face of said putter is in an open position, a closed position, or the proper position, said impact actuator mounted within said module and operably connected to a first terminal of said Y-axis sensor electrical switch, a right electrical contact adjacent to said impact actuator and operably connected to a second terminal of said Y-axis sensor electrical switch, and a left electrical contract adjacent to said impact actuator and operably connected to a third terminal of said Y-axis sensor electrical switch, whereby said impact actuator completes an internal circuit and closes said switch when said striking face is in an open or a closed position and activates said first or second light emitting diodes; and X-axis sensor means disposed in an X plane that is perpendicular to the Y plane and is in the same plane as said shaft, and X-axis sensor means comprises third and fourth light emitting diodes connected in said electronic circuit to give a visual signal to the user whether said head is accelerating or decelerating abnormally, IR light pulse emitter operably connected to said third and fourth light emitting diodes, IR light pulse detector operably connected to said third and fourth light emitting diodes, a pendulum positioned within the path of light pulses between said emitter and said detector, and a fulcrum fixedly attached to said pendulum and rotatably mounted within said module, whereby an internal circuit of said X-axis sensor means is completed when said pendulum moves out of the path of said pulses as a result of the user causing said putter head to move in other than a smooth pendulum-like stroke and activates said fourth light emitting diodes.

18. The putting stroke training device of claim 17 wherein said module is mounted within said putter.

19. The putting stroke training device of claim 17 wherein said module is mounted on said top of said putter.

20. The putting; stroke training device of claim 17 wherein said module contains a printed circuit board for said electronic circuit.

21. The putting stroke training device of claim 17 wherein a Z-axis switch means for activating said X-axis and Y-axis sensor means when said sole plate of the putter is raised and lowered against a hard surface is operably connected to said X-axis and Y-axis sensor means within said module.

22. The putting stroke training device of claim 17 wherein said IR light pulse detector is a photo-transistor.

23. The putting stroke training device of claim 22 wherein said IR light pulse emitter is a light emitting diode.

24. The putting stroke training device of claim 17 wherein said third light emitting diode emits a pulse of light having a color distinguishable from the pulses emitted by said first, second and fourth light emitting diodes and wherein said fourth light emitting diode has light-emitting voltage threshold that is less than that of said third light emitting diode.

25. The putting stroke training device of claim 24 wherein a blanking circuit means is connected in said electronic circuit for disabling the operation of said third light emitting diode in the event said pendulum oscillates across the path of light from said IR light pulse emitter and said detector at the relatively high frequency signal that occurs upon impact of the putter head with the golf ball.

26. The putting stroke training device of claim 17 wherein said Y-axis sensor electrical switch is a two pole electrical switch.

* * * * *